US005569540A

United States Patent [19]

Hirose et al.

[11] Patent Number: 5,569,540

[45] Date of Patent: Oct. 29, 1996

[54] THERMAL TRANSFER SHEET

[75] Inventors: Keiji Hirose; Keiichi Ogawa, both of Tokyo, Japan

[73] Assignee: Dai Nippon Printing Co., Ltd., Japan

[21] Appl. No.: 262,064

[22] Filed: Jun. 17, 1994

[30] Foreign Application Priority Data

Jun. 18, 1993 [JP] Japan ..... 5-170901
Jun. 18, 1993 [JP] Japan ..... 5-170902

[51] Int. Cl.[6] ..... B41M 5/00

[52] U.S. Cl. ..... 428/500; 428/195; 428/516; 428/518; 428/522; 428/913; 428/914

[58] Field of Search ..... 428/195, 488.1, 428/488.4, 500, 913, 914, 516, 518, 522

[56] References Cited

U.S. PATENT DOCUMENTS 5,198,296 3/1993 Suzuki et al. ..... 428/336

FOREIGN PATENT DOCUMENTS 61-47296 3/1986 Japan ..... 428/195

OTHER PUBLICATIONS

Derwent Accession No. 88–093 940, Questel Telesystems (WPIL) Derwent Publications Ltd., London; & JP–A–63–042 891 (Fukue, T.).

Derwent Accession No. 90–234 242, Questel Telesystems (WPIL) Derwent Publications Ltd., London; & JP–A–02–160 585 (Ricoh K. K.).

*Primary Examiner*—Pamela R. Schwartz

*Attorney, Agent, or Firm*—Parkhurst, Wendel & Burr, L.L.P.

[57] ABSTRACT

A thermal transfer sheet including a substrate film, a release layer provided on the substrate film and an ink layer provided on the release layer. The ink layer includes a colorant and a vinyl chloride/vinyl acetate copolymer resin having a Tg of 60° to 90° C. and an average molecular weight of not less than 10,000. The release layer includes a material having at a high temperature, a low adhesion to plastic material and a low fluidity.

9 Claims, 1 Drawing Sheet

THERMAL TRANSFER SHEET

BACKGROUND OF THE INVENTION

1. Field of the Invention

The present invention relates to thermal transfer sheets for thermal transfer printers used as a hard copy output device in personal computers, word processors and the like, and more particularly to thermal transfer sheets which can provide prints having excellent rubbing/scratch resistance and solvent resistance when printing is carried out on various plastics under high printing energy conditions.

2. Background Art

A hot-melt thermal transfer sheet formed by coating an ink comprising a mixture of wax with a pigment on one side (surface) of a substrate film by means of a coater to form a hot-melt ink layer has hitherto been widely used as a thermal transfer sheet at the time of printing of hard copies for personal computers, word processors and the like by the thermal transfer system.

In the thermal transfer sheet having a thermal transfer ink layer composed mainly of wax, the thermal transfer sheet is imagewise heated by means of a thermal head from the back surface thereof to melt the thermal transfer ink in the thermal transfer ink layer. At that time, an image is formed on a material, on which an image is to be transferred, by taking advantage of the adhesive property of the ink layer developed by the heating. For this reason, the ink layer and the release layer each comprise a low-melting material.

Due to the use of the low-melting material, prints formed by such a thermal transfer sheet have poor rubbing and scratch resistance. Further, the resistance of the prints to various general-purpose solvents is also poor. Therefore, it is difficult to use the above thermal transfer sheet in applications where scratch resistance and solvent resistance are required, particularly in printing on plastic labels, plastic cards, plastic bags and the like.

On the other hand, printing under high printing energy conditions (high temperatures) has been proposed in order to enhance the fixability of the ink onto the surface of plastic materials. This method, however, can cause unfavorable phenomena, such as fusing of the release layer and further the substrate film onto prints due to the high temperature, tearing of the substrate film or occurrence of dropout, which is detrimental to the film formability of the surface of the print, thus resulting in a deterioration of rubbing/scratch resistance and solvent resistance of the prints.

Japanese Patent Laid-Open No. 42891/1988 discloses a thermal printing medium comprising a substrate sheet, a transparent or semi-transparent protective layer provided on one surface of the substrate sheet and comprising a chlorinated polyolefin resin and an ink layer provided on the surface of the transparent or semi-transparent protective layer and comprising a mixture of a polymer of an acrylic or methacrylic ester with a colorant. This thermal printing medium is described to enable the formation of any image, such as bar codes and letters, on plastic articles, unattainable by the conventional thermal printing media.

In this thermal printing medium, however, the transparent or semi-transparent protective layer is provided so that it is transferred together with the ink layer to a recording medium, on which an image is to be transferred, thereby protecting the surface of the transferred ink layer, and printing under high energy printing conditions is not taken into consideration.

Accordingly, an object of the present invention is to solve the above-described problems of the prior art and to provide a thermal transfer sheet which can provide a good print even under high energy printing conditions (not less than 0.4 mj/dot), the print being excellent also in rubbing/scratch resistance and solvent resistance.

Another object of the present invention is to provide a thermal transfer sheet which can provide a good print on the surface of plastic materials (materials on which an image is to be printed), polyethylene terephthalate (PET), vinyl chloride and acrylic plastics, print being excellent also in the rubbing/scratch resistance and solvent resistance.

SUMMARY OF THE INVENTION

In order to attain the above objects, according to one aspect of the present invention, there is provided a thermal transfer sheet comprising a substrate film and an ink layer provided on said substrate film, said ink layer comprising a colorant and a vinyl chloride/vinyl acetate copolymer resin having a Tg of 60° to 90° C. and an average molecular weight of not less than 10,000.

According to another aspect of the present invention, there is provided a thermal transfer sheet comprising a substrate film, a release layer provided on said substrate film and an ink layer provided on said release layer, said release layer comprising a material having at a high temperature a low adhesion to the plastic material and a low fluidity.

According to a further aspect of the present invention, there is provided a thermal transfer sheet comprising a substrate film, a release layer provided on said substrate film and an ink layer provided on said release layer, said ink layer comprising a colorant and a vinyl chloride/vinyl acetate copolymer resin having a Tg of 60° to 90° C. and an average molecular weight of not less than 10,000, said release layer comprising a material having at a high temperature a low adhesion to the plastic material and a low fluidity.

The material for constituting the release layer is selected from materials which exhibit a good peelability and, at the same time, cause substantially no change in coated face in a test conducted by a method which comprises a) coating a coating solution for a release layer to be evaluated on a 25 μm-thick PET film at a coverage of 1.0 g/m$^2$, b) putting another PET film on the coated PET film and subjecting the laminate to heat sealing under conditions of a load of 3.5 kgf/cm$^2$, a sealing temperature of 200° C. and a sealing time of 3 sec and c) immediately after the completion of heat sealing, peeling off the two PET films to observe the coated face of the release layer with the naked eye. For example, polymers having a chlorine content of not less than 60% by weight, preferably not less than 65% by weight, are preferred.

In the thermal transfer sheet of the present invention, the provision of an ink layer using as a binder a vinyl chloride/vinyl acetate copolymer resin having a Tg of 60° to 90° C. and an average molecular weight of not less than 10,000 improves the compatibility of the ink with plastic materials (materials on which an image is to be printed), which contributes to an improvement in solvent resistance of the print.

Further, in the thermal transfer sheet of the present invention, the release layer provided on the substrate film comprises a resin having at a high temperature a low adhesive property and a low fluidity. This enables fusing between the substrate film and the ink layer to be prevented even when a high printing energy is applied, so that the resultant print has good fixability onto the surface of the plastic material, rubbing/scratch resistance and solvent resistance.

DETAILED DESCRIPTION OF THE PREFERRED EMBODIMENTS

The thermal transfer sheet of the present invention will now be described in more detail with reference to the following preferred embodiments.

Figure 1:
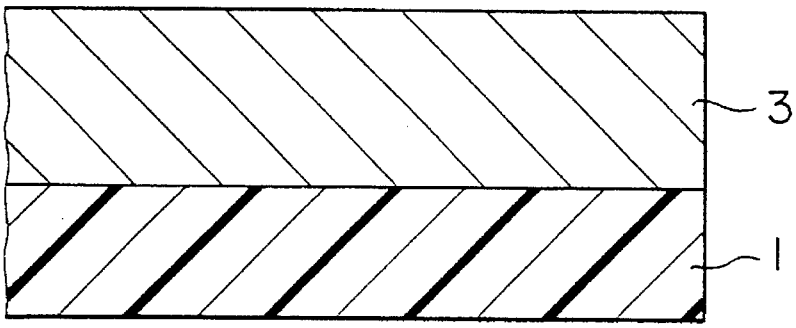
FIG. 1 is a cross-sectional view of the first embodiment of the thermal transfer sheet according to the present invention.

FIG. 1 shows a first embodiment of the thermal transfer sheet according to the present invention. The thermal transfer sheet according to the first embodiment comprises a substrate film 1 and a hot-melt ink layer 3 provided on the substrate film. The hot-melt ink layer 3 comprises a resin binder having a good compatibility with the substrate film 1 of a plastic material and excellent solvent resistance.

Figure 2:
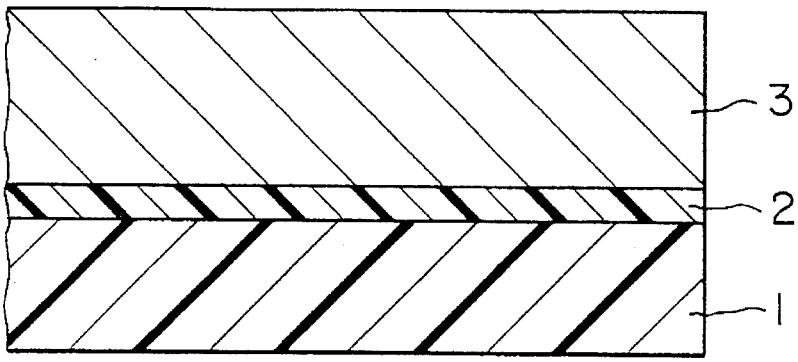
FIG. 2 is a cross-sectional view of the second embodiment of the thermal transfer sheet according to the present invention.

FIG. 2 shows a second embodiment of the thermal transfer sheet according to the present invention. The thermal transfer sheet according to the second embodiment comprises a substrate film 1, a release layer 2 provided on the substrate film and a hot-melt ink layer 3 provided on the release layer 2. In this thermal transfer sheet, since the release layer 2 comprises a resin having at a high temperature a low adhesive property and a low fluidity, a good print can be provided also when printing is carried out under high energy conditions.

Figure 3:
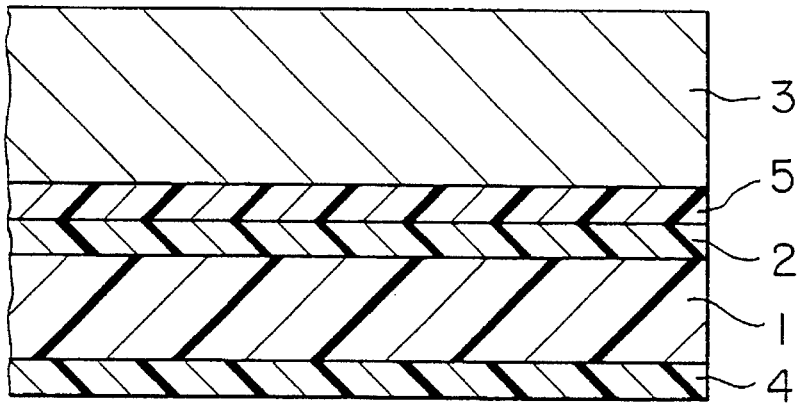
FIG. 3 is a cross-sectional view of the third embodiment of the present invention.

FIG. 3 shows a third embodiment of the thermal transfer sheet according to the present invention. The thermal transfer sheet according to the third embodiment of the present invention comprises a substrate film 1, a back surface layer 4 provided on the back surface of the substrate film 1, a release layer 2 provided on the substrate film 1, a protective layer 5 provided on the release layer 2 and a hot-melt ink layer 3 provided on the protective layer 5. The back surface layer 4 is a heat-resistant protective layer which serves to impart sufficient lubricity to a thermal head and, at the same time, to prevent deposition of contaminants on the thermal head. The protective layer 5 serves to impart resistance to plasticizers, rubbing/scratch resistance and solvent resistance after printing to the print.

Substrate Film

In the present invention, the substrate film 1 used in the present invention is not particularly limited and may be the same as the substrate film used in the conventional thermal transfer sheets. Specific preferred examples of the material for constituting the substrate film 1 include films of plastics, such as polyesters, polypropylene, cellophane, polycarbonates, cellulose acetate, polyethylene, polyvinyl chloride, polystyrene, nylons, polyimides, polyvinylidene chloride, polyvinyl alcohol, fluororesins, chlorinated rubber and ionomers, various types of paper, such as capacitor paper and paraffin paper, and nonwoven fabrics. Further, composite materials comprising a combination of the above materials may also be used.

The thickness of the substrate film 1 may be properly selected depending upon materials used so that the strength and the thermal conductivity of the substrate film are proper. For example, it is preferably in the range of from about 2 to 25 μm.

If necessary, a back surface layer comprising a heat-resistant resin and a thermal release agent or a lubricant may be provided on the back surface of the substrate film 1 for the purpose of rendering the thermal heat smoothly slidable and, at the same time, preventing sticking.

Release Layer

The release layer 2 is composed mainly of a resin having at a high temperature a low adhesion and a low fluidity and serves to prevent occurrence of fusing between the substrate film 1 and the hot-melt ink layer 3 at the time of printing under high energy conditions, thereby providing a good print.

The resin having at a high temperature a low adhesion and a low fluidity is a material which exhibits a good peelability and, at the same time, causes substantially no change in a coated face in a test conducted by a method which comprises a) coating a coating solution for a release layer to be evaluated on a 25 μm-thick PET film at a coverage of 1.0 $g/m^2$, b) putting another PET film on the coated PET film and subjecting the laminate to heat sealing under conditions of a load of 3.5 $kgf/cm^2$, a sealing temperature of 200° C. and a sealing time of 3 sec and c) immediately after the completion of heat sealing, peeling off the two PET films to observe the coated face of the release layer with the naked eye. More specifically, the use of polymers having a chlorine content of not less than 60% by weight, preferably not less than 65% by weight, is preferred.

A highly chlorinated polymer exhibits lowered adhesive property and fluidity at a high temperature. The reason for this is believed as follows. The substitution of H in the polymer crystal with Cl inhibits crystallization, which leads to the development of an adhesive property at a high temperature. A further increase in the chlorine content results in a further increase in tendency of inhibiting the crystallization. In this case, however, the mutual action between molecules is increased by virtue of the polarity of chlorine, which contributes to an improvement in heat resistance, so that the adhesive property is not developed even at a high temperature.

The term "chlorine content" used herein is intended to mean the weight ratio of chlorine contained in the chlorinated polymer. The chlorinated polymers include highly chlorinated polyethylene, highly chlorinated polypropylene and chlorinated rubber, and chlorinated polypropylene having a chlorine content of not less than 60% by weight, preferably not less than 65% by weight, is particularly preferred.

The term "chlorinated polypropylene" used herein is intended to mean a chlorinated polypropylene resin which has a low adhesion and a low fluidity at a high temperature, preferably highly chlorinated polypropylene having a Tg of 90° C. or above and a chlorine content of not less than 60% by weight, preferably not less than 65% by weight. When the Tg is below 90° C., fusing between the release layer 2 and the substrate film 1 (for example, a polyester) unfavorably occurs at the time of printing under high printing energy conditions. When the chlorine content is less than 60%, fusing between the release layer 2 and the substrate film 1 (for example, a polyester) unfavorably occurs at the time of printing under high printing energy conditions, so that the release layer 2 cannot function satisfactorily.

The release layer 2 is composed mainly of the above-described chlorinated polypropylene. If necessary, various additives may be added thereto. For examples, an ethylene/vinyl acetate copolymer resin, a polyester, an acrylic resin or the like may be added in an amount of 0 to 20% by weight, preferably about 10% by weight, for the purpose of preventing the ink layer from falling off in a flaky form during storage.

Further, in order to further improve the rubbing/scratch resistance, it is possible to add polyethylene wax in an amount of 0 to 20%, preferably about 5% by weight.

The release layer 2 is preferably as thin as possible from the viewpoint of preventing a lowering in sensitivity of the thermal transfer sheet, and the coverage is preferably in the range of from about 0.1 to 0.5 g/m$^2$.

Hot-Melt Ink Layer

The hot-melt ink layer is provided on the release layer 2 (or directly on the substrate film with the release layer omitted), and the thickness thereof is preferably in the range of from about 0.5 to 5.0 μm. The hot-melt ink layer comprises a resin component as a binder and a colorant and, if necessary, various additives.

Examples of the resin component as the binder include ethylene/vinyl acetate copolymer resin, ethylene/ethyl acrylate copolymer resin, polyamide resin, polyester resin, epoxy resin, polyurethane resin, acrylic resin, vinyl chloride resin, cellulosic resin, polyvinyl alcohol resin, petroleum resin, phenolic resin, styrene resin, and elastomers, such as natural rubber, styrene/butadiene rubber, isoprene rubber and chloroprene rubber. Among them, resins and elastomers having a softening point in the range of from 50° to 150° C. and an average molecular weight in the range of from 5,000 to 50,000 are preferred.

The resin component as the binder preferably has a Tg of 60° to 90° C. and an average molecular weight of not less than 10,000 from the viewpoint of preventing occurrence of blocking when the thermal transfer sheet is taken up into a roll. Particularly preferred is a vinyl chloride/vinyl acetate copolymer resin having a Tg of 60° to 90° C. and an average molecular weight of not less than 10,000. Moreover, waxes, amides, esters or salts of high fatty acids, fluororesins, powders of inorganic substances and the like may be added as an anti-blocking agent.

The colorant may be properly selected from known organic or inorganic pigments or dyes. For example, it preferably has a sufficient color density and neither discolors nor fades upon exposure to light, heat and the like. Further, it may be a material which develops a color upon heating or upon contact with a component coated on the surface of a material to which an image is to be transferred. Moreover, the color of the colorant is not limited to cyan, magenta, yellow and block, and colorants of various other colors may be used.

In the ink layer, the weight ratio of the resin component to the colorant is preferably in the range of from 30:70 to 95:5, still preferably in the range of from 40:60 to 90:10.

Protective Layer

In the thermal transfer sheet of the present invention, if necessary, a protective layer 5 composed mainly of PMMA (a polymethyl methacrylate resin) may be provided between the release layer 2 and the hot-melt ink layer 3. The protective layer 5 serves to impart resistance to plasticizers, rubbing/scratch resistance and solvent resistance after printing to the resultant print.

Polyethylene wax may be added in an amount of 0 to 20% by weight, preferably about 10% by weight, to the protective layer 5 for the purpose of enhancing the rubbing/scratch resistance.

Further, in order to enhance the adhesion of the protective layer to the release layer 2, it is also possible to add to the protective layer 5 ethylene/vinyl acetate copolymer resin, polyesters, acrylic resin and other resins in an amount of 0 to 20% by weight, preferably about 10% by weight.

The thermal transfer sheet of the present invention may be prepared by successively forming the above-described intended layer(s) on a substrate according to any conventional method commonly used in the art. For example, it may be formed as follows. Components for constituting an intended layer, together with optional additives, are added to and dissolved or dispersed in a suitable solvent, if necessary, using a dispersing device, such as an attritor, a ball mill or a sand mill, to prepare a coating solution in the form of a solution or a dispersion. The coating solution is coated by means of a coater, such as a gravure coater or a roll coater, and the resultant coating is then dried. If necessary, the above procedure is repeated for successively forming the other intended layers. Thus, the thermal transfer sheet of the present invention can be provided.

EXAMPLES

The present invention will now be described in more detail with reference to the following examples, though it is not limited to these examples only.

Example 1

A 4.5 μm-thick polyethylene terephthalate film (Lumirror manufactured by Toray Industries, Inc.) was provided for use as a substrate film, and an ink having the following composition for a back surface layer was coated on one surface of the substrate film and dried to form a back surface layer.

| Ink for back surface layer: coverage 0.15 g/m$^2$ | |
|---|---|
| Styrene/acrylonitrile copolymer (Cevian AD manufactured by Daicel Chemical Industries, Ltd.) | 6 parts by weight |
| Linear saturated polyester (Elitel UE3200 manufactured by Unitika Ltd.) | 0.3 part by weight |
| Zinc stearyl phosphate (LBT1830 manufactured by Sakai Chemical Co., Ltd.) | 3 parts by weight |
| Urea resin crosslinked powder (Organic filler, particle diameter: 0.14 μm manufactured by Nippon Kasei Chemical Co., Ltd.) | 3 parts by weight |
| Melamine resin crosslinked powder (Epostar S, particle diameter: 0.3 μm manufactured by Nippon Shokubai Kagaku Kogyo Co., Ltd.) | 1.5 parts by weight |
| Flux (MEK/toluene = 1/1) | 86.2 parts by weight |

Then, the following components of an ink composition for a release layer were dispersed in each other by means of an attritor as a dispersing device to prepare a coating solution for a release layer. The coating solution was coated on the other surface of the substrate film remote from the back surface layer at a coverage of 0.3 g/m$^2$ by means of a gravure coater as a coating device to form a release layer.

| Ink for release layer | |
|---|---|
| Chlorinated polypropylene (Tg: 130° C., chlorine content: 65% by weight) | 30 parts by weight |
| Toluene | 70 parts by weight |

Then, the following components of an ink composition for an ink layer were dispersed in one another by means of an attritor as a dispersing device to prepare a coating solution for an ink layer. The coating solution was coated on the surface of the release layer at a coverage of 0.8 g/m$^2$ by means of a gravure coater as a coating device to form an ink layer, thereby preparing the thermal transfer sheet of the present invention (Sample 1).

| Ink for ink layer | |
|---|---|
| Carbon black | 25 parts by weight |
| Acrylic resin (Tg: 55° C., molecular weight: 30,000) | 25 parts by weight |
| Toluene | 50 parts by weight |

Comparative Example 1

A thermal transfer sheet was prepared in the same manner as in Example 1, except that an ink having the following composition for a release layer was used instead of the ink for release layer used in Example 1.

| Ink for release layer | |
|---|---|
| Carnauba wax | 45 parts by weight |
| Acrylic resin (Tg: 55° C.) | 5 parts by weight |
| Toluene | 50 parts by weight |

Example 2

A 6 μm-thick back coated film K200S6E for thermal transfer (a film with a back surface layer provided thereon, manufactured by Diafoil Hoechst Co., Ltd.) was provided for use as a substrate film.

Then, a release layer, a protective layer and an ink layer respectively having the following compositions were formed in that order on the surface of the substrate film remote from the back surface layer by coating in the same manner as in Example 1, thereby preparing the thermal transfer sheet (Sample 2) of the present invention.

| Ink for release layer: coverage 0.4 g/m$^2$ | | |
|---|---|---|
| Chlorinated polypropylene | Chlorine content: 64% by weight Average molecular weight: 75,000 Melting point: 180° C. | 30 parts by weight |
| Toluene | | 35 parts by weight |

-continued

| | | |
|---|---|---|
| MEK | | 35 parts by weight |
| Ink for protective layer: coverage 1.0 g/m$^2$ | | |
| Polymethyl methacrylate (PMMA) | Tg: 105° C. Average molecular weight: 40,000 | 30 parts by weight |
| Toluene | | 35 parts by weight |
| MEK | | 35 parts by weight |
| Ink for ink layer: coverage 0.9 g/m$^2$ | | |
| Vinyl chloride/ vinyl acetate copolymer | Tg: 68° C. Average molecular weight: 15,000 Vinyl chloride/vinyl acetate: 82/18 | 12.5 parts by weight |
| Toluene | | 40 parts by weight |
| MEK | | 35 parts by weight |
| Carbon | | 12.5 parts by weight |

Example 3

A 4.5 μm-thick polyethylene terephthalate film (Lumirror manufactured by Toray Industries, Inc. ) was provided for use as a substrate film, and an ink having the following composition for a back surface layer was coated on one surface of the substrate film and dried to form a back surface layer.

Then, a release layer, a protective layer and an ink layer respectively having the following compositions were formed in that order on the surface of the substrate film remote from the back surface layer by coating in the same manner as in Example 1, thereby preparing the thermal transfer sheet (Sample 3) of the present invention.

| Ink for back surface layer: coverage 0.15 g/m$^2$ | |
|---|---|
| Styrene/acrylonitrile copolymer (Cevian AD manufactured by Daicel Chemical Industries, Ltd.) | 6 parts by weight |
| Linear saturated polyester (Elitel UE3200 manufactured by Unitika Ltd.) | 0.3 part by weight |
| Zinc stearyl phosphate (LBT1830 manufactured by Sakai Chemical Co., Ltd.) | 3 parts by weight |
| Urea resin crosslinked powder (Organic filler, particle diameter: 0.14 μm manufactured by Nippon Kasei Chemical Co., Ltd.) | 3 parts by weight |
| Melamine resin crosslinked powder (Epostar S, particle diameter: 0.3 μm manufactured by Nippon Shokubai Kagaku Kogyo Co., Ltd.) | 1.5 parts by weight |
| Flux (MEK/toluene = 1/1) | 86.2 parts by weight |

| Ink for release layer: coverage 0.4 g/m$^2$ | | |
|---|---|---|
| Chlorinated polypropylene | Chlorine content: 64% by weight Average molecular weight: 75,000 Melting point: 180° C. | 30 parts by weight |
| Toluene | | 35 parts by weight |
| MEK | | 35 parts by weight |
| Ink for protective layer: coverage 1.0 g/m$^2$ | | |
| Polymethyl methacrylate (PMMA) | Tg: 105° C. Average molecular weight: 45,000 | 30 parts by weight |

-continued

| | | |
|---|---|---|
| Toluene | | 35 parts by weight |
| MEK | | 35 parts by weight |
| Ink for ink layer: coverage 0.9 g/m$^2$ | | |
| Polyester (Vylon 200 manufactured by Toyobo Co., Ltd.) | | 9 parts by weight |
| Carbon | | 21 parts by weight |
| Toluene | | 35 parts by weight |
| MEK | | 35 parts by weight |
| Comparative Example 2 | | |
| The procedure of Example 2 was repeated, except that the composition for the release layer was changed as follows. | | |
| Ink for release layer: coverage 0.7 g/m$^2$ | | |
| Carnauba wax emulsion (solid content: 40%) | | 50 parts by weight |
| IPA | | 50 parts by weight |
| Comparative Example 3 | | |
| The procedure of Example 1 was repeated, except that the composition for the release layer was changed as follows. | | |
| Ink for release layer: coverage 1.0 g/m$^2$ | | |
| Polymethyl methacrylate (PMMA) | Tg: 105° C. Average molecular weight: 45,000 | 30 parts by weight |
| Toluene | | 35 parts by weight |
| MEK | | 35 parts by weight |
| Comparative Example 4 | | |
| The procedure of Example 2 was repeated, except that the composition for the release layer was changed as follows. | | |
| Ink for release layer: coverage 0.4 g/m$^2$ | | |
| Low chlorinated polypropylene | Chlorine content: 30% by weight Melting point: 100° C. | 30 parts by weight |
| Toluene | | 35 parts by weight |
| MEK | | 35 parts by weight |

The thermal transfer sheets prepared in the above examples and comparative examples were used to print a bar code pattern on a PET (polyethylene terephthalate) film label under the following printing conditions by means of a bar code printer BC8MK manufactured by Auto Nics Co., Ltd.

Printing Conditions

1) High energy printing Printing energy: 0.712 mj/dot

2) Low energy printing Printing energy: 0,294 mj/dot

The printed bar codes were read with AUTOSCAN manufactured by RJS to evaluate the quality of the prints. The results are given in Table 1.

Printability

When the print was scanned by AUTOSCAN manufactured by RJS,

○: successful reading

X: failure of reading

Rubbing/Scratch Resistance

Apparatus: HEIDON-14 manufactured by HEIDON

Load: 300 g (rubbing/scratching with a stainless ball under this load)

Rate of travel: 6,000 mm/min

Number of times of rubbing/scratching: 40

Chemical Resistance

The test was carried out under the same conditions as those described above in connection with the rubbing/scratch resistance test, except that the sample was wetted with denatured ethanol as an organic solvent for 5 min.

Adhesive Property

The adhesion between the printed ink and the polyethylene terephthalate (PET) label was evaluated as follows. An adhesive tape (a cellophane tape) was put on the printed ink face and then peeled off in a direction vertical to the printed ink face.

After the above rubbing/scratch resistance, chemical resistance and adhesive property tests, the bar codes were again read with AUTOSCAN to measure the reflectance. When the difference in reflectance between before the test and after the test was 5 or less, the property was evaluated as ○, while when the difference exceeded 5, the property was evaluated as X.

Further, the resins for a release layer used in Examples 1 to 3 and Comparative Examples 1 to 4 were subjected to the following comparison test. The results are also given in Table 1.

Comparison Test for Materials for Release Layer

The suitabilities of various materials for a release layer in a thermal transfer sheet were compared by the following evaluation method. The results of evaluation was given in Table 1.

Evaluation method:

1. A coating solution for a release layer to be evaluated was coated on a 25 μm-thick PET film at a coverage of 1.0 g/m$^2$.
2. Another PET film was put on the coated PET film, and the laminate was heat-sealed under conditions of a load of 3.5 kgf/cm$^2$, a sealing temperature of 200° C. and a sealing time of 3 sec.
3. Immediately after the completion of heat sealing, the two PET films were peeled off to observe the coated face of the release layer with the naked eye.

Criteria of evaluation:

Peeling: ○=easy to peel, X=adhered

State of coated face: ○=no change, X=whitened

TABLE 1

| | High-energy printing | | | | Low-energy printing | | | | Comparative test on materials for release layer | |
|---|---|---|---|---|---|---|---|---|---|---|
| | Print-ability | Rubbing/ scratch resistance | Chemical resistance | Adhesive property | Print-ability | Rubbing/ scratch resistance | Chemical resistance | Adhesive property | Peeling | State of coated face |
| Ex. 1 | ○ | ○ | ○ | ○ | X | X | X | X | ○ | ○ |
| Comp. Ex. 1 | X | X | X | X | ○ | X | X | X | X | — |
| Ex. 2 | ○ | ○ | ○ | ○ | X | X | X | X | ○ | ○ |
| Ex. 3 | ○ | ○ | ○ | ○ | X | X | X | X | ○ | ○ |
| Comp. Ex. 2 | X | X | X | X | ○ | X | X | X | ○ | X |
| Comp. Ex. 3 | X | X | X | X | X | X | X | X | X | — |
| Comp. Ex. 4 | X | X | X | X | ○ | ○ | ○ | ○ | X | — |

Example 4

A 4.5 μm-thick polyethylene terephthalate film (Lumirror manufactured by Toray Industries, Inc.) was provided for use as a substrate film, and an ink having the following composition for a back surface layer was coated on one surface of the substrate film and dried to form a back surface layer.

Then, the following components of an ink composition for an ink layer were dispersed in one another by means of an attritor as a dispersing device to prepare a coating solution for an ink layer. The coating solution was coated on the surface of the substrate film remote from the back surface layer at a coverage of 0.8 g/m$^2$ by means of a gravure coater as a coating device to form a hot-melt ink layer, thereby preparing the thermal transfer sheet of the present invention (Sample 4).

| Ink for ink layer | | |
|---|---|---|
| Vinyl chloride/ vinyl acetate copolymer resin | Tg: 68° C. Average molecular weight: 15,000 | 15 parts by weight |
| Carbon black | | 10 parts by weight |
| Toluene | | 75 parts by weight |

Comparative Example 5

A thermal transfer sheet sample was prepared in the same manner as in Example 2, except that a vinyl chloride/vinyl acetate copolymer resin having a Tg of 55° C. and an average molecular weight of 27,000 was used instead of the vinyl chloride/vinyl acetate copolymer resin used in Example 2.

Comparative Example 6

A vinyl chloride/vinyl acetate copolymer resin having a Tg of 90° C. and an average molecular weight of 10,000 was used. However, the dissolution thereof was so difficult that an ink could not be prepared.

Comparative Example 7

A thermal transfer sheet sample was prepared in the same manner as in Example 2, except that a vinyl chloride/vinyl acetate copolymer resin having a Tg of 65° C. and an average molecular weight of 8,000 was used instead of the vinyl chloride/vinyl acetate copolymer resin used in Example 2.

Comparative Example 8

A thermal transfer sheet sample was prepared in the same manner as in Example 2, except that an acrylic resin (Tg: 60° C., average molecular weight: 30,000) was used instead of the vinyl chloride/vinyl acetate copolymer resin used in Example 2.

The thermal transfer sheets thus obtained were used to print a bar code pattern on three types of plastic films, that is, polyvinyl chloride, polyethylene terephthalate (PET) and acrylic films, by means of a bar code printer BC8MK manufactured by Auto Nics Co., Ltd. (printing energy: 0.352 mj/dot).

The printed bar codes were subjected to the following tests to evaluate the quality of the prints. The results are given in Table 2.

Printability

When the print was scanned with AUTOSCAN manufactured by RJS,

○: successful reading

X: failure of reading

Rubbing/Scratch Resistance

Apparatus: HEIDON-14 manufactured by HEIDON

Load: 300 g (rubbing/scratching with a stainless boll under this load)

Rate of travel: 6,000 mm/min

Number of times of rubbing/scratching: 40

Chemical Resistance

The sample was immersed in denatured ethanol for 5 min and then subjected to a test under the same conditions as those described above in connection with the rubbing/scratch resistance test.

After the above rubbing/scratch resistance and chemical resistance tests, the bar codes were again read with AUTOSCAN to measure the reflectance. When the difference in reflectance between before the test and after the test was 5 or less, the property was evaluated as ○, while when the difference exceeded 5, the property was evaluated as X.

Further, the thermal transfer sheets prepared above were evaluated for storage stability under the following storing conditions. The results are also given in Table 2.

Criteria of evaluation for storage stability:

○: No offset observed

X: Offset observed

Evaluation conditions for storage stability:

The thermal transfer sheet was subjected to ribboning, stored in this state at a temperature of 55° C. and a humidity of 85% for 24 hr and then evaluated.

TABLE 2

| Substrate sheet on which an image is to be transferred | Printability | | | Chemical resistance | | | Scratch preventive | | | Storage stability |
|---|---|---|---|---|---|---|---|---|---|---|
| | Vinyl chloride | PET | Acrylic | Vinyl chloride | PET | Acrylic | Vinyl chloride | PET | Acrylic | — |
| Ex. 4 | O | O | O | O | O | O | O | O | O | O |
| Comp. Ex. 5 | X | X | X | O | O | O | O | O | O | X |
| Comp. Ex. 6 | X | X | X | O | O | O | O | O | O | X |
| Comp. Ex. 7 | O | O | O | O | O | O | O | O | O | X |
| Comp. Ex. 8 | O | O | X | X | X | X | O | X | X | X |

We claim:

1. A thermal transfer sheet for thermally printing an image on a plastic surface, comprising:

a substrate film; and an ink layer provided on said substrate film, said ink layer comprising a colorant and a vinyl chloride/vinyl acetate copolymer resin having a Tg of 60° to 90° C. and an average molecular weight of not less than 10,000.

2. The thermal transfer sheet of claim 1, further comprising a back surface layer provided on the back surface of said substrate film.

3. The thermal transfer sheet of claim 1, further comprising a protective layer provided between said substrate film and said ink layer.

4. A thermal transfer sheet for thermally printing an image on a plastic surface, comprising:

a substrate film;

a release layer provided on said substrate film, said release layer comprising a chlorinated polymer having a chlorine content of at least 60% by weight; and an ink layer provided on said release layer, said ink layer comprising a colorant and a vinyl chloride/vinyl acetate copolymer resin having a Tg of 60° to 90° C. and an average molecular weight of not less than 10,000.

5. The thermal transfer sheet of claim 4, wherein said chlorinated polymer has a chlorine content of at least 65% by weight.

6. The thermal transfer sheet of claim 5, wherein said chlorinated polymer is chlorinated polypropylene.

7. The thermal transfer sheet of claim 4, further comprising a back surface layer provided on the back surface of said substrate film.

8. The thermal transfer sheet of claim 4, further comprising a protective layer provided between said release layer and said ink layer.

9. An assemblage for thermal transfer printing, comprising:

an image-receiving article having a plastic surface; and a thermal transfer sheet for thermally printing an image on the plastic surface of said image-receiving article, said thermal transfer sheet comprising:

(i) a substrate film; and (ii) an ink layer provided on said substrate film, said ink layer comprising a colorant and a vinyl chloride/vinyl acetate copolymer resin having a Tg of 60° to 90° C. and an average molecular weight of not less than 10,000.

* * * * *